US009045987B2

(12) United States Patent
Levine et al.

(10) Patent No.: US 9,045,987 B2
(45) Date of Patent: Jun. 2, 2015

(54) COOLING FOR A TURBINE AIRFOIL TRAILING EDGE

(75) Inventors: Jeffrey R. Levine, Vernon Rockville, CT (US); Dominic J. Mongillo, West Hartford, CT (US); Brandon S. Donnell, Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 538 days.

(21) Appl. No.: 13/524,295

(22) Filed: Jun. 15, 2012

(65) Prior Publication Data

US 2013/0336767 A1 Dec. 19, 2013

(51) Int. Cl.
*F01D 5/18* (2006.01)
*F01D 9/04* (2006.01)

(52) U.S. Cl.
CPC ..... *F01D 5/187* (2013.01); *F01D 5/186* (2013.01); *F05D 2240/304* (2013.01); *F05D 2260/202* (2013.01); *F01D 9/041* (2013.01); *F05D 2240/122* (2013.01)

(58) Field of Classification Search
CPC ..... F01D 5/186; F01D 5/187; F01D 9/02; F01D 25/12; F05D 2260/202; F05D 2260/204; F05D 2240/122; F05D 2240/304
USPC ..... 415/115; 416/97 R
See application file for complete search history.

(56) References Cited

U.S. PATENT DOCUMENTS

| | | | | |
|---|---|---|---|---|
| 6,174,135 | B1 | 1/2001 | Lee | |
| 6,328,531 | B1 | 12/2001 | Bariaud et al. | |
| 6,481,967 | B2 | 11/2002 | Tomita et al. | |
| 6,984,103 | B2 * | 1/2006 | Lee et al. | 415/115 |
| 7,600,972 | B2 * | 10/2009 | Benjamin et al. | 416/97 R |
| 7,775,769 | B1 | 8/2010 | Liang | |
| 8,002,525 | B2 | 8/2011 | Whalley | |
| 8,047,787 | B1 | 11/2011 | Liang | |
| 2003/0223870 | A1 | 12/2003 | Keith et al. | |
| 2005/0095129 | A1 | 5/2005 | Benjamin et al. | |
| 2009/0068021 | A1 | 3/2009 | Liang | |
| 2011/0236223 | A1 | 9/2011 | Nagler et al. | |
| 2012/0282107 | A1 * | 11/2012 | Liang et al. | 416/97 R |

OTHER PUBLICATIONS

International Search Report and Written Opinion, mailed Jan. 9, 2014.

* cited by examiner

*Primary Examiner* — Ninh H Nguyen
(74) *Attorney, Agent, or Firm* — Kinney & Lange, P.A.

(57) ABSTRACT

An assembly for a gas turbine engine includes a first platform and an airfoil extending from the first platform. The airfoil includes a first fillet, pressure side biased discharge openings, and a first center cooling discharge opening. A pressure side wall of the airfoil and the first platform form an acute angle at the trailing edge. The first fillet is formed around a perimeter of the airfoil where the airfoil extends from the first platform. The pressure side biased cooling discharge openings are along the trailing edge outside of the first fillet. Each pressure side biased cooling discharge opening extends from the trailing edge along the pressure side wall. The first center cooling discharge opening extends along the trailing edge into the first fillet and is centrally located between the pressure side wall and the suction side wall.

17 Claims, 4 Drawing Sheets

COOLING FOR A TURBINE AIRFOIL TRAILING EDGE

STATEMENT OF GOVERNMENT INTEREST

This invention was made with U.S. Government support under Contract No. N00019-02-C-3003 awarded by the United States Navy. The U.S. Government has certain rights in the invention.

BACKGROUND

The present invention relates to a turbine engine. In particular, the invention relates cooling turbine airfoils in a gas turbine engine.

A turbine engine ignites compressed air and fuel to create a flow of hot combustion gases to drive multiple stages of turbine blades. The turbine blades extract energy from the flow of hot combustion gases to drive a rotor. The turbine rotor drives a fan to provide thrust and drives a compressor to provide a flow of compressed air. Vanes interspersed between the multiple stages of turbine blades align the flow of hot combustion gases for an efficient attack angle on the turbine blades.

Rotors and vanes each typically include an airfoil and at least one platform from which the airfoil extends. Combustion gases flowing past airfoils tend to form vortices at the platform surface. Such vortices waste useful energy and reduce the efficiency of the turbine engine. Turbine engines may include rotor or vane airfoils that are curved or bowed to improve the efficiency of the turbine engine by directing the combustion gases away from platforms at the ends of the airfoils, thereby reducing the vortices.

Rotor and vane airfoils are exposed to high-temperature combustion gases and must be cooled to extend their useful lives. Cooling air is typically taken from the flow of compressed air. A portion of the cooling air passes through and cools the airfoil before discharging through cooling discharge openings at a trailing edge of the airfoil. The cooling air discharging from these openings cools the trailing edge. Airfoil trailing edges are made as thin as practical for improved aerodynamic efficiency. Such thin trailing edges limit the cross-sectional area available at the trailing edge for cooling discharge openings. Thus, turbine airfoils may have cooling discharge openings at the trailing edge that extend from the trailing edge along a pressure side of the airfoil. Such pressure side biased cooling discharge openings provide the increased area necessary for the thin trailing edge to receive sufficient cooling air.

SUMMARY

Embodiments of the present invention include a assembly for a gas turbine engine, the assembly including a first platform and an airfoil extending from the first platform. The airfoil includes a suction side wall, a pressure side wall, a first fillet, pressure side biased discharge openings, and a first center cooling discharge opening. The suction side wall connects a leading edge and a trailing edge. The pressure side wall is spaced apart from the suction side wall and also connects the leading edge and the trailing edge. The pressure side wall and the first platform form an acute angle at the trailing edge. The first fillet is formed around a perimeter of the airfoil where the airfoil extends from the first platform. The pressure side biased cooling discharge openings are along the trailing edge outside of the first fillet. Each pressure side biased cooling discharge opening extends from the trailing edge along the pressure side wall. The first center cooling discharge opening extends along the trailing edge into the first fillet. The first center cooling discharge opening is centrally located between the pressure side wall and the suction side wall.

DETAILED DESCRIPTION

Figure 1:
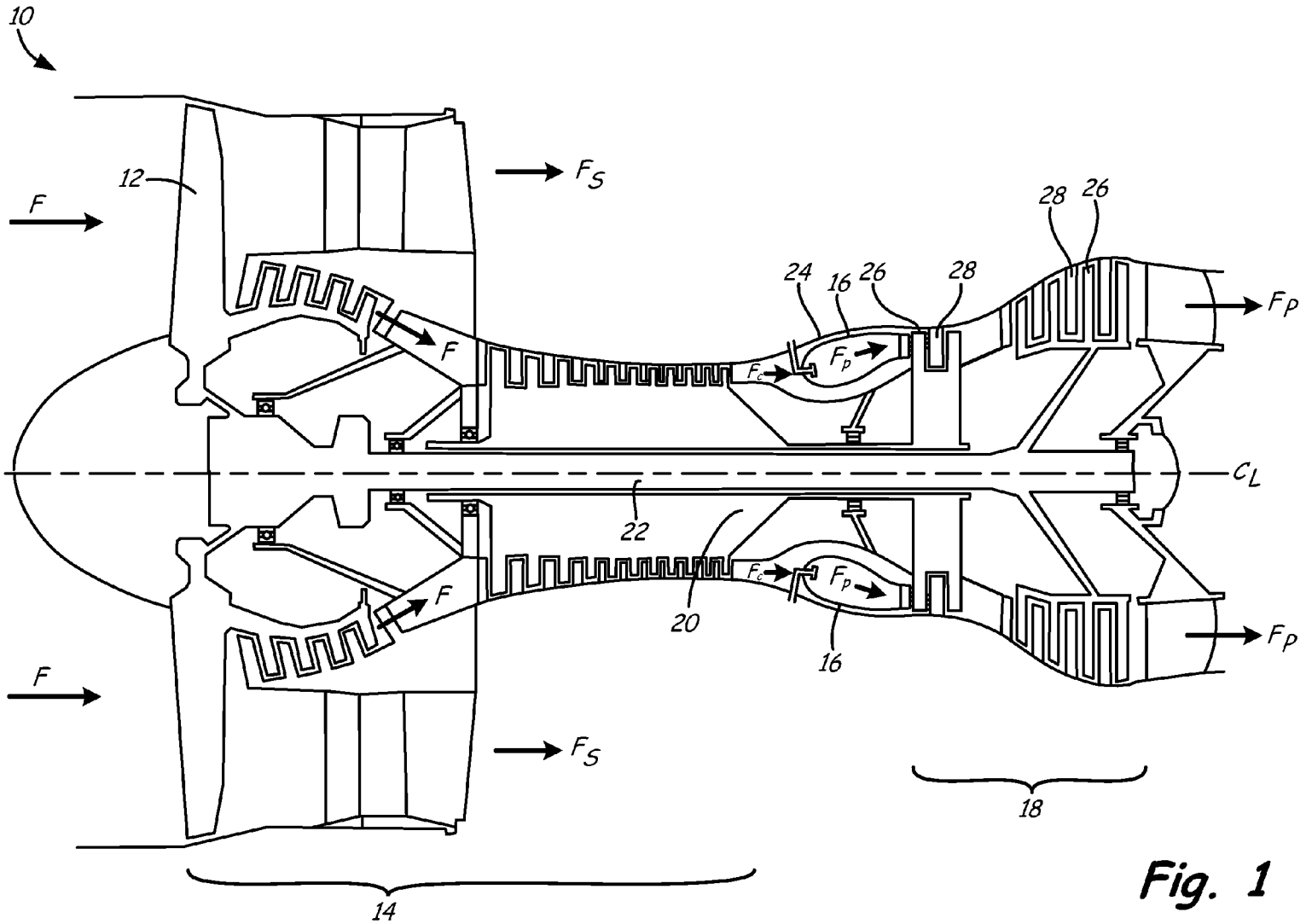
FIG. 1 is a sectional view of a gas turbine engine embodying an assembly employing only center discharge cooling openings in the fillet of a bowed airfoil at the trailing edge.

As noted above, pressure side biased cooling discharge openings at a trailing edge of a turbine airfoil provide sufficient cooling air to the trailing edge that would otherwise have to be much thicker to provide the necessary cooling opening cross-sectional area. Stator vanes and rotor blades are typically cast as a single piece and pressure side biased cooling discharge openings are created in the casting process. Stator vanes and rotor blades also include a fillet created in the casting process, the fillet formed around a perimeter of the airfoil where the airfoil extends from the platform. The additional material provided by the fillet increases the mechanical strength where the airfoil and the platform meet. The additional mechanical strength is particularly important for airfoils that are bowed. Bowed airfoils that form an acute angle between the airfoil and the platform have inherently higher stresses in the fillet region compared with non-bowed airfoil. This due to the additional mechanical loading and pressure loading of the bowed airfoil. However, for airfoils that are bowed, providing pressure side biased cooling discharge openings in the fillet at the trailing edge has proven to be difficult and expensive.

The process of casting a stator vane or a rotor blade results in metal flash being produced around the pressure side biased cooling discharge openings. For those pressure side biased cooling discharge openings at the trailing edge outside of the fillet, removing the metal flash is relatively straightforward because the openings are easily accessible and the surrounding surface geometry is not complex. In addition, outside of the fillet, the mechanical strength requirement is not as critical, so there is greater margin regarding the amount of material removed during the process. In contrast, for pressure side biased cooling discharge openings at the trailing edge that extend into the fillet, removing the metal flash can be difficult and time consuming. As a result of the acute angle formed between the tangentially bowed airfoil surface and the platform surface, there is limited access and visibility to adequately and consistently remove the metal flash around the pressure side biased cooling discharge openings extending into the fillet. Typically, finishing of this region is done manually and is operator dependent which can result in large variations in the finished product, leading to increased scrap due to geometry variations that do not meet design blueprint requirements. The primary purpose of the fillet is to provide mechanical strength. Non-uniform material removal results may result in compromised and variable mechanical strength. The increased time associated with hand finishing and increased scrap due to labor intensive operations results in increased part cost.

The present invention overcomes these difficulties in stator vanes and rotor blades with bowed airfoils by eliminating pressure side biased cooling discharge openings at the trailing edge from the fillet and employing only center cooling discharge openings in the fillet. Center cooling discharge openings extend along the trailing edge and are centrally located between a pressure side wall and a suction side wall of the vane airfoil. Center cooling discharge openings created during the casting process do not have metal flash around the openings. Thus, there is no need to remove material from the fillet and no difficult and expensive blending of the openings with the surrounding metal surface. In addition, because center cooling discharge openings do not extend along the pressure side wall as do pressure side biased cooling discharge openings, more metal remains in the fillet after casting to provide greater mechanical strength. The result is a robust fillet with minimal structural variations and lower mechanical stresses. Also, center cooling discharge slots have greater internal heat transfer ability when compared to pressure side biased cooling discharge openings. Thus, the invention provides the additional benefit of reducing the fillet temperature, thereby extending the life of the stator vane or rotor blade.

FIG. 1 is a representative illustration of a gas turbine engine including airfoils embodying the present invention. The view in FIG. 1 is a longitudinal sectional view along an engine center line. FIG. 1 shows gas turbine engine 10 including fan 12, compressor 14, combustor 16, turbine 18, high-pressure rotor 20, low-pressure rotor 22, and engine casing 24. Turbine 18 includes rotor stages 26 and stator stages 28.

As illustrated in FIG. 1, fan 12 is positioned along engine center line $C_L$ at one end of gas turbine engine 10. Compressor 14 is adjacent fan 12 along engine center line $C_L$, followed by combustor 16. Turbine 18 is located adjacent combustor 16, opposite compressor 14. High-pressure rotor 20 and low-pressure rotor 22 are mounted for rotation about engine center line $C_L$. High-pressure rotor 20 connects a high-pressure section of turbine 18 to compressor 14. Low-pressure rotor 22 connects a low-pressure section of turbine 18 to fan 12. Rotor blades 26 and stator vanes 28 are arranged throughout turbine 18 in alternating rows. Rotor blades 26 connect to high-pressure rotor 20 and low-pressure rotor 22. Engine casing 24 surrounds turbine engine 10 providing structural support for compressor 14, combustor 16, and turbine 18, as well as containment for cooling air flows Fc.

In operation, air flow F enters compressor 14 through fan 12. Air flow F is compressed by the rotation of compressor 14 driven by high-pressure rotor 20. The compressed air from compressor 14 is divided, with a portion going to combustor 16, and another portion, cooling air flow Fc, employed for cooling components exposed to high-temperature combustion gases, such as stator vanes 28, as described below. Compressed air and fuel are mixed and ignited in combustor 16 to produce high-temperature, high-pressure combustion gases Fp. Combustion gases Fp exit combustor 16 into turbine section 18. Stator vanes 28 properly align the flow of combustion gases Fp for an efficient attack angle on subsequent rotor blades 26. The flow of combustion gases Fp past rotor blades 26 drives rotation of both high-pressure rotor 20 and low-pressure rotor 22. High-pressure rotor 20 drives a high-pressure portion of compressor 14, as noted above, and low-pressure rotor 22 drives fan 12 to produce thrust Fs from gas turbine engine 10. Although embodiments of the present invention are illustrated for a turbofan gas turbine engine for aviation use, it is understood that the present invention applies to other aviation gas turbine engines and to industrial gas turbine engines as well.

For brevity, the embodiments described below are with respect to stator vanes. However, it is understood that embodiments of the present invention encompass rotor blades as well as stator vanes.

Figure 2:
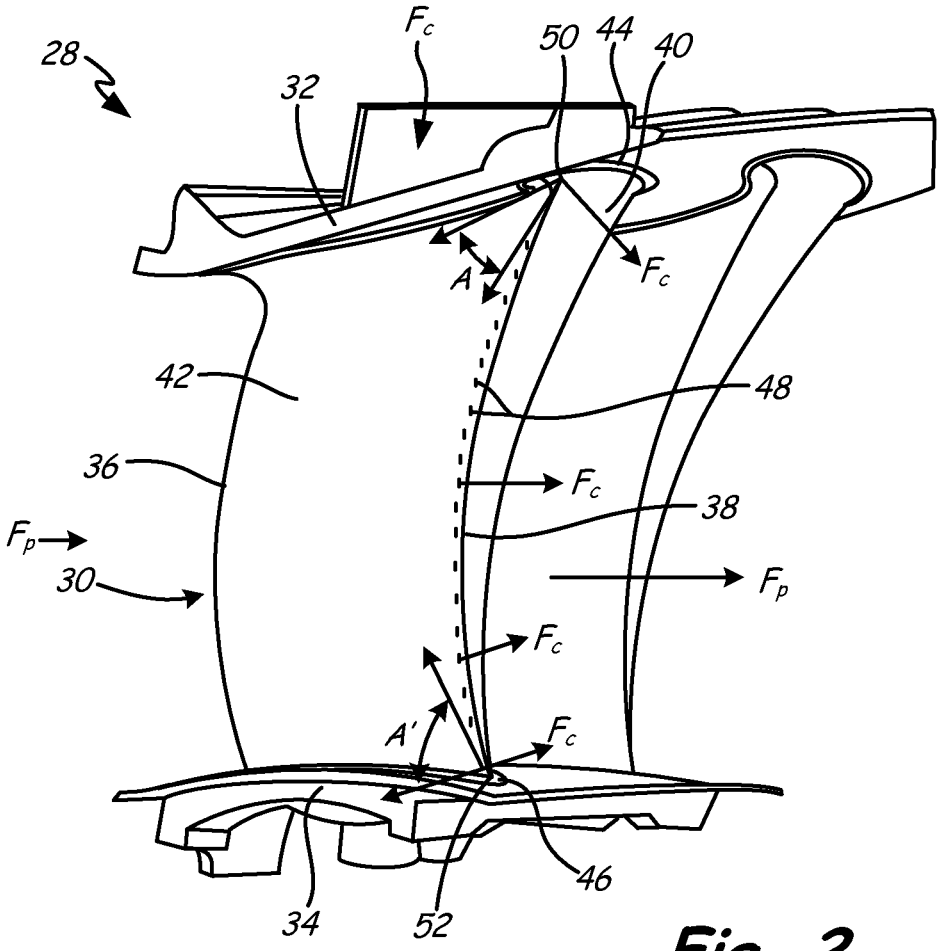
FIG. 2 is an enlarged perspective view of a pair of stator vanes illustrating an embodiment of a stator vane employing only center cooling discharge openings in the fillet of a bowed airfoil at the trailing edge.

FIG. 2 is an enlarged view of a stator vane segment having a pair of stator vanes, including stator vane 28. Stator vane 28 includes vane airfoil 30, vane outside diameter (OD) platform 32, and vane inside diameter (ID) platform 34. Vane OD platform 32 and vane ID platform 34 are predominantly arcuate in shape in a circumferential direction with a center of the arc coincident with engine center line $C_L$ shown in FIG. 1. Vane airfoil 30 includes leading edge 36, trailing edge 38, suction side wall 40, pressure side wall 42, OD fillet 44, ID fillet 46, pressure side biased cooling discharge openings 48, center cooling discharge opening 50 and center cooling discharge opening 52. Vane airfoil 30 is bowed and extends from vane OD platform 32 such that pressure side wall 42 and vane OD platform 32 form acute angle A at trailing edge 38. Vane ID platform 34 connects to vane airfoil 30 opposite vane OD platform 32 such that pressure side wall 42 and vane ID platform 34 for an acute angle A' at trailing edge 38. Suction side wall 40 connects leading edge 36 and trailing edge 38. Pressure side wall 42 is spaced apart from suction side wall 40 and also connects leading edge 36 and trailing edge 38. Fillet 44 is formed around a perimeter of airfoil 30 where vane airfoil 30 meets vane OD platform 32. Fillet 46 is formed around a perimeter of vane airfoil 30 where airfoil 30 meets vane ID platform 34. Each of fillet 44 and fillet 46 may be a simple fillet having a single radius of curvature, a compound fillet or an elliptical fillet. A plurality of pressure side biased cooling discharge openings 48 is disposed along trailing edge 38 outside of fillet 44 and fillet 46. Center cooling discharge opening 50 extends along trailing edge 48 into fillet 44. Center cooling discharge opening 52 extends along trailing edge 48 into fillet 46.

Figure 3:
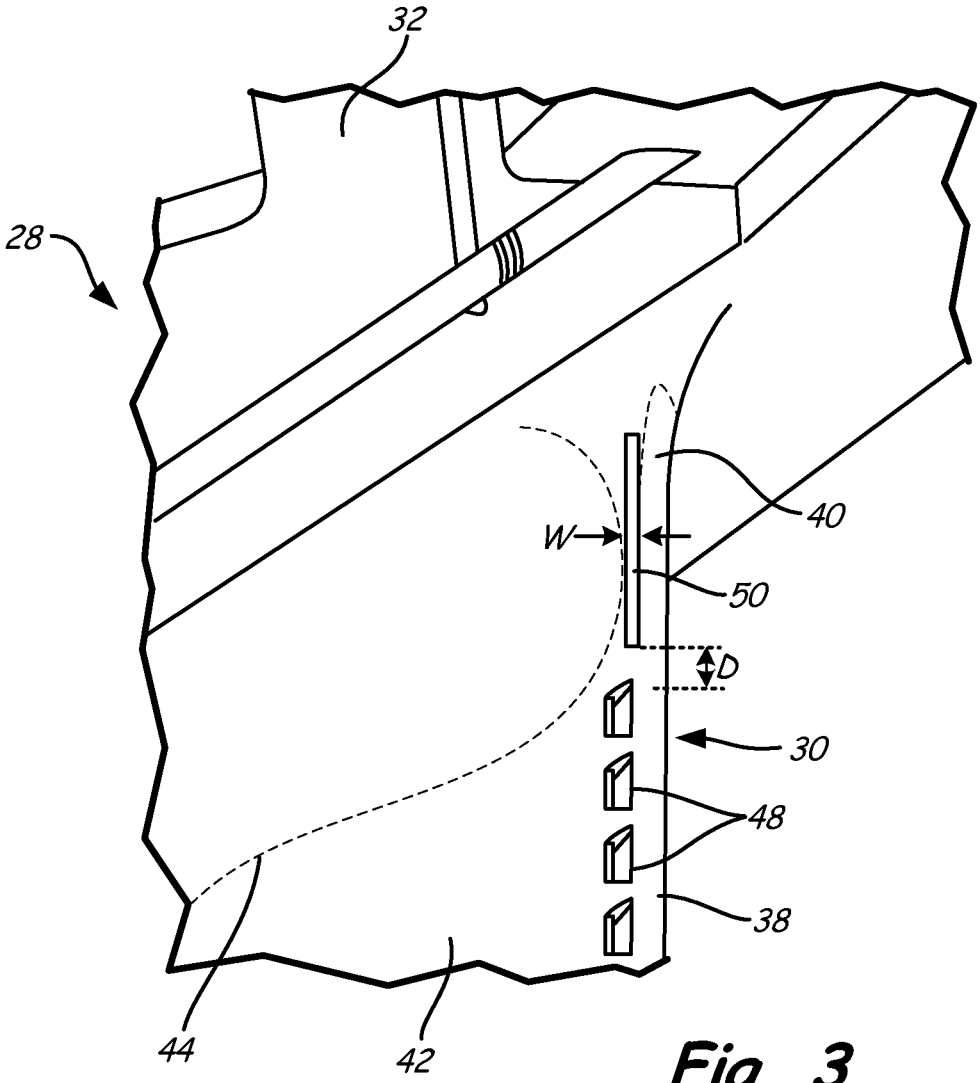
FIG. 3 is a further enlarged perspective view of a portion of the stator vane of FIG. 2.

FIG. 3 is a further enlarged perspective view of a portion of stator vane 28 of FIG. 2 where vane airfoil 30 extends from vane OD platform 32 FIG. 3 shows pressure side biased cooling discharge openings 48 disposed along trailing edge 38 outside of fillet 44. Each pressure side biased cooling discharge opening 48 extends from trailing edge 38 along pressure side wall 42. Center cooling discharge opening 50 extends along trailing edge 38 into fillet 44. Cooling discharge opening 50 is separated from pressure side biased cooling discharge opening 48 nearest fillet 44 by distance D. Center cooling discharge opening 50 is centrally located between suction side wall 40 and pressure side wall 42. In the embodiment shown in FIG. 3, center cooling discharge opening 50 has a rectangular shape and minimum width W between pressure side wall 42 and suction side wall 40. For efficient flow of cooling air flow Fc and cooling of fillet 44, minimum width W may be not less than 0.008 inches (0.20 mm). In addition, to ensure structural integrity and adequate cooling, distance D may be not less than 0.015 inches (0.38 mm) and may be not greater than 0.100 inches (2.54 mm). For brevity, the similar view for fillet 46 is not shown, although it is understood that center cooling discharge opening 52 is similar, having a rectangular shape and minimum width W' between pressure side wall 42 and suction side wall 40, minimum width W' may be not less than 0.008 inches (0.20 mm); and separated from pressure side biased cooling discharge opening 48 nearest fillet 46 by distance D', where distance D' may be not less than 0.015 inches (0.38 mm) and may be not greater than 0.100 inches (2.54 mm).

Considering FIGS. 1, 2, and 3 together, in operation, as the flow of combustion gases Fp passes through stator vane 28, vane airfoil 30 properly aligns the flow of combustion gases Fp. Because vane airfoil 30 is bowed, flow of combustion gases Fp is directed away from vane OD platform 32 and vane ID platform 34 to reduce formation of energy wasting vortices. Cooling air flow Fc from compressor 14 flows into the space between suction side wall 40 and pressure side wall 42, cooling vane airfoil 30. Cooling air flow Fc is discharged from vane airfoil 30 through pressure side biased cooling discharge openings 48, center cooling discharge opening 50, and center cooling discharge 52, thus cooling trailing edge 38. By employing center cooling discharge openings 50 and 52 which do not extend along pressure side wall 42, instead of pressure side biased cooling discharge openings 48 in fillets 44 and 46, more metal remains in fillets 44 and 46 to provide lower mechanical stresses in stator vane 28. Also, because center cooling discharge openings 50 and 52 have greater internal heat transfer ability when compared to pressure side biased cooling discharge openings 48, this embodiment provides the additional benefit of reducing temperature of fillets 44 and 46, thereby extending the life of stator vane 28. Most importantly, employing only center cooling discharge openings 50 and 52 in fillets 44 and 46, respectively, eliminates the need to remove metal flash from the area of restricted access and visibility due to the bow of vane airfoil 30.

A method of producing embodiments of the present invention described above in reference to FIGS. 2 and 3 includes casting stator vane 28 as a single piece and removing metal flashing from only a portion of a plurality of cooling discharge openings along trailing edge 38, the portion including the plurality of pressure side biased cooling discharge openings 48. The remaining portion of cooling discharge openings along the trailing edge are all center cooling discharge openings (center cooling discharge openings 50 and 52) which do not require removal of metal flashing around the openings after casting. There is no need to remove material from fillets 44 and 46 and no difficult and expensive blending of the openings with the surrounding metal surface.

Figure 4:
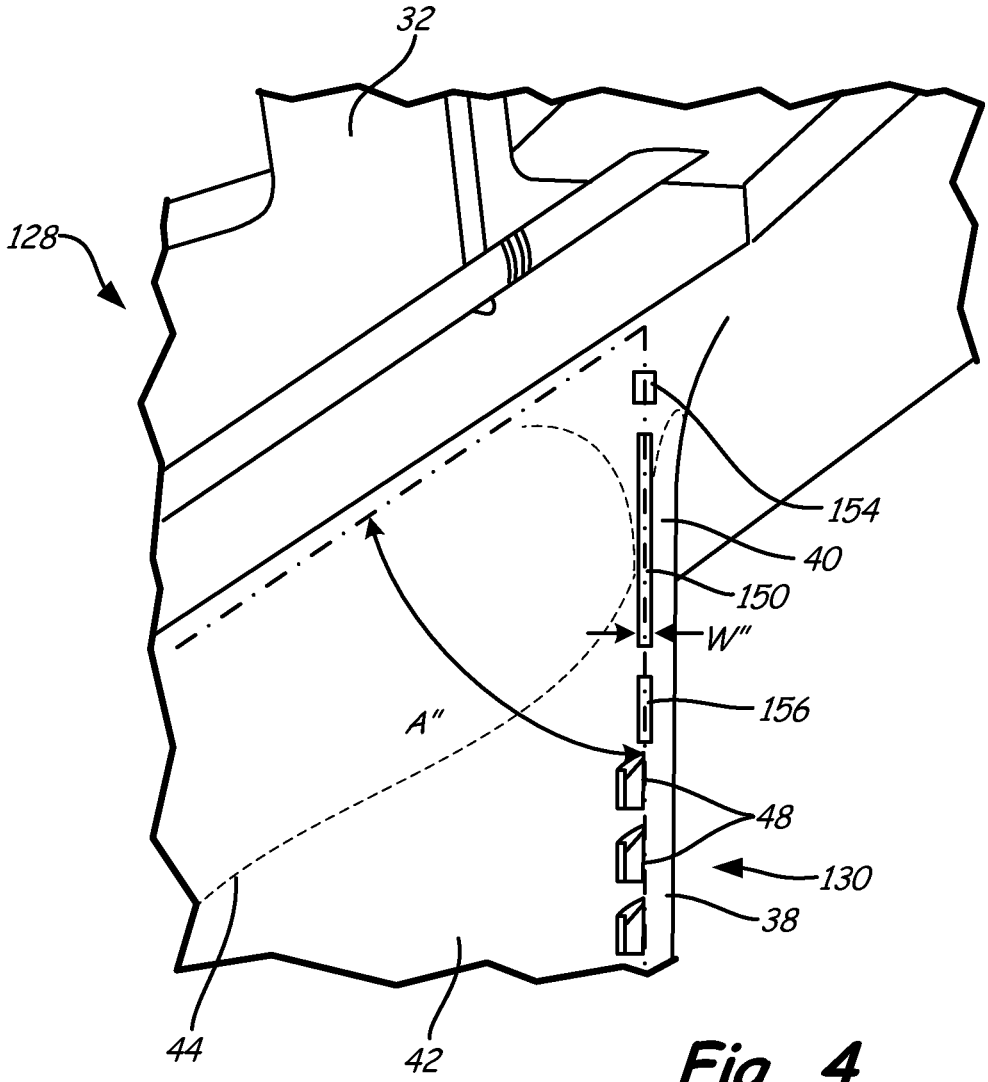
FIG. 4 is an enlarged perspective view of a portion of a stator vane illustrating another embodiment of a stator vane employing only center cooling discharge openings in the fillet of a bowed airfoil at the trailing edge.

FIG. 4 is an enlarged perspective view of a portion of stator vane 128 illustrating another embodiment of a stator vane employing only center cooling discharge openings in the fillet of a bowed airfoil at a trailing edge. The embodiment of FIG. 4 includes additional central cooling discharge openings for applications requiring greater cooling. Stator vane 128 of embodiment of FIG. 4 is similar to stator vane 28 of the embodiment described above in reference to FIG. 3, except that vane airfoil 130 of stator vane 128 includes additional central cooling discharge openings 154 and 156. Vane airfoil 130 is bowed and extends from vane OD platform 32 such that pressure side wall 42 and vane OD platform 32 form acute angle A" at trailing edge 38. Vane airfoil 130 also includes central cooling discharge opening 150 instead of central cooling discharge opening 50. Central cooling discharge opening 150 extends along trailing edge 38 and is centrally located between pressure side wall 42 and suction side wall 40. Central cooling discharge opening 150 has a trapezoidal shape such that minimum width W" between pressure side wall 42 and suction side wall 40 is at and end of central cooling discharge opening 150 farthest from vane OD platform 32 and the width of central cooling discharge opening 150 nearest an end of central cooling discharge opening 150 nearest vane OD platform 32 is greater than W". Similar to the previous embodiment, for efficient flow of cooling air flow Fc and cooling of fillet 44, minimum width W" may be not less than 0.008 inches (0.20 mm).

Central cooling discharge openings 154 and 156 are centrally located between pressure side wall 42 and suction side wall 40. Central cooling discharge opening 154 extends along trailing edge 38 and is completely within fillet 44. Central cooling discharge opening 156 extends along trailing edge 38 between pressure side biased cooling discharge opening 48 nearest fillet 44 and central cooling discharge opening 150.

Operation of the embodiment of FIG. 4 is as described above for FIG. 3, except that cooling air flow Fc is discharged from vane airfoil 130 through center cooling discharge openings 150, 154 and 156, in addition to pressure side biased cooling discharge openings 48. As with the previous embodiment, by employing center cooling discharge openings 150, 154, and 156 which do not extend along pressure side wall 42 instead of pressure side biased cooling discharge openings 48 in fillet 44, more metal remains in fillet 44 to provide lower mechanical stresses in stator vane 28. Also, because center cooling discharge openings 150, 154, and 156 have greater internal heat transfer ability when compared to pressure side biased cooling discharge openings 48, this embodiment provides the additional benefit of reducing temperature of fillet 44, thereby extending the life of stator vane 128. Most importantly, because unlike pressure side biased cooling discharge openings 48, center cooling discharge openings 150, 154, and 156 do not require the removal of metal flash. This eliminates many difficulties in removing metal flash due to the limited physical access to such openings in fillet 44 because the vane airfoil 130 is bowed in such a way that pressure side wall 42 forms acute angle A" with vane OD platform 32, restricting access of tools and visibility during the process of removing the metal flash.

The embodiments describe above are illustrated with center discharge openings that are rectangular and trapezoidal. However, it is understood that the present invention encompasses embodiments having center discharge openings of other shapes including, for example, circular, elliptical, diamond, and square.

Embodiments of the present invention eliminate pressure side biased cooling discharge openings from a fillet at a trailing edge of a bowed stator vane or rotor blade airfoil and employ center cooling discharge openings instead. Center cooling discharge openings created during the casting process do not have metal flash around the openings. Thus, there is no need to remove material from the fillet and no difficult and expensive blending of the openings with the surrounding metal surface. In addition, because center cooling discharge openings do not extend along the pressure wall as do pressure side biased cooling discharge openings, more metal remains in the fillet after casting to provide greater mechanical strength. The result is a robust fillet with minimal structural variations and lower mechanical stresses. Also, center cooling discharge slots have greater internal heat transfer ability when compared to pressure side biased cooling discharge openings. Thus, the invention provides the additional benefit of reducing the fillet temperature, thereby extending the life of the stator vane or the rotor blade.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

Discussion of Possible Embodiments

The following are non-exclusive descriptions of possible embodiments of the present invention.

An assembly for a gas turbine engine can include a first platform and an airfoil extending from the first platform; the airfoil includes a suction side wall connecting a leading edge and a trailing edge; a pressure side wall spaced apart from the suction side wall, the pressure side wall connecting the leading edge and the trailing edge, the pressure sidewall and the first platform forming an acute angle at the trailing edge; a first fillet formed around a perimeter of the airfoil where the airfoil extends from the first platform; a plurality of pressure side biased cooling discharge openings along the trailing edge outside of the first fillet, each pressure side biased cooling discharge opening extending from the trailing edge along the pressure side wall; and a first center cooling discharge opening extending along the trailing edge into the first fillet, the first center cooling discharge opening centrally located between the pressure side wall and the suction side wall.

The component of the preceding paragraph can optionally include, additionally and/or alternatively, any one or more of the following features, configurations and/or additional components:

the assembly is at least one of a stator vane or a rotor blade;

the airfoil further includes at least one second center cooling discharge opening extending along the trailing edge within the first fillet, the second center cooling discharge opening centrally located between the pressure side wall and the suction side wall;

the airfoil further includes at least one second center cooling discharge opening extending along the trailing edge between the pressure side biased cooling discharge opening nearest the first fillet and the first center cooling discharge opening, the second center cooling discharge opening centrally located between the pressure side wall and the suction side wall;

the first center cooling discharge opening has a width between the pressure side wall and the suction side wall of no less than 0.008 inches (0.20 mm);

an end of the first center cooling discharge opening farthest from the first platform has a width between the pressure side wall and the suction side wall of about 0.008 inches (0.20 mm) and an end of the first center cooling discharge opening nearest the first platform has a width between the pressure side wall and the suction side wall of greater than 0.008 inches (0.20 mm);

the first center cooling discharge opening is separated from the pressure side biased cooling discharge opening nearest the first fillet by a distance of between about 0.015 inches and 0.100 inches (0.38 mm and 2.54 mm); and a second platform connected to the airfoil opposite the first platform such that the pressure side wall and the second platform form an acute angle at the trailing edge; and the airfoil further includes: a second fillet formed around a perimeter of the airfoil where the airfoil connects to the second platform; the plurality of pressure side biased cooling discharge openings along the trailing edge not extending into the second fillet; and a second center cooling discharge opening extending along the trailing edge into the second fillet, the second center cooling discharge opening centrally located between the pressure side wall and the suction side wall.

A gas turbine engine can include a compressor section and a turbine section connected to the compressor section such that the compressor section provides at least cooling air to the turbine section; the turbine section including: a plurality of assemblies, at least one of the plurality of assemblies including: a first platform; an airfoil extending from the first platform the airfoil includes a suction side wall connecting a leading edge and a trailing edge; a pressure side wall spaced apart from the suction side wall, the pressure side wall connecting the leading edge and the trailing edge, the pressure sidewall and the first platform forming an acute angle at the trailing edge; a first fillet formed around a perimeter of the airfoil where the airfoil extends from the first platform; a plurality of pressure side biased cooling discharge openings along the trailing edge outside of the first fillet, each pressure side biased cooling discharge opening extending from the trailing edge along the pressure side wall; and a first center cooling discharge opening extending along the trailing edge into the first fillet, the first center cooling discharge opening centrally located between the pressure side wall and the suction side wall.

The component of the preceding paragraph can optionally include, additionally and/or alternatively, any one or more of the following features, configurations and/or additional components:

the assembly is at least one of a stator vane or a rotor blade;

the airfoil further includes at least one second center cooling discharge opening extending along the trailing edge within the first fillet, the second center cooling discharge opening centrally located between the pressure side wall and the suction side wall;

the airfoil further includes at least one second center cooling discharge opening extending along the trailing edge between the pressure side biased cooling discharge opening nearest the first fillet and the first center cooling discharge opening, the second center cooling discharge opening centrally located between the pressure side wall and the suction side wall;

the first center cooling discharge opening has a width between the pressure side wall and the suction side wall of no less than 0.008 inches (0.20 mm);

an end of the first center cooling discharge opening farthest from the first platform has a width between the pressure side wall and the suction side wall of about 0.008 inches (0.20 mm) and an end of the first center cooling discharge opening nearest the first platform has a width between the pressure side wall and the suction side wall of greater than 0.008 inches (0.20 mm);

the first center cooling discharge opening is separated from the pressure side biased cooling discharge opening nearest the first fillet by a distance of between about 0.015 inches and 0.100 inches (0.38 mm and 2.54 mm); and a second platform connected to the airfoil opposite the first platform such that the pressure side wall and the second platform form an acute angle at the trailing edge; and the airfoil further includes: a second fillet formed around a perimeter of the airfoil where the airfoil connects to the second platform; the plurality of pressure side biased cooling discharge openings along the trailing edge not extending into the second fillet; and a second center cooling discharge opening extending along the trailing edge into the second fillet, the second center cooling discharge opening centrally located between the pressure side wall and the suction side wall.

A method for producing an assembly for a turbine engine, the assembly including a platform and an airfoil extending from the platform, the airfoil including a suction side wall connecting a leading edge and a trailing edge; a pressure side wall spaced apart from the suction side wall, the pressure side wall connecting the leading edge and the trailing edge, the pressure sidewall and the first platform forming an acute angle at the trailing edge; a fillet formed around a perimeter of the airfoil where the airfoil extends from the first platform; a plurality cooling discharge openings along the trailing edge including a plurality of pressure side biased cooling discharge openings and a center cooling discharge opening; the pressure side biased cooling discharge openings disposed outside of the fillet and the center cooling discharge opening extending along the trailing edge into the fillet; each pressure side biased cooling discharge opening extending from the trailing edge along the pressure side wall and the center cooling discharge opening centrally located between the pressure side wall and the suction side wall; the method can include casting the assembly as a single piece; and removing metal flashing from only a portion of the plurality of cooling discharge openings, the portion consisting of the plurality of pressure side biased cooling discharge openings.

The invention claimed is:

1. An assembly for a gas turbine engine, the assembly comprising:

a first platform;

an airfoil extending from the first platform, the airfoil including:

a suction side wall connecting a leading edge and a trailing edge;

a pressure side wall spaced apart from the suction side wall, the pressure side wall connecting the leading edge and the trailing edge, the pressure sidewall and the first platform forming an acute angle at the trailing edge;

a first fillet formed around a perimeter of the airfoil where the airfoil extends from the first platform;

a plurality of pressure side biased cooling discharge openings along the trailing edge outside of the first fillet, each pressure side biased cooling discharge opening extending from the trailing edge along the pressure side wall; and a first center cooling discharge opening extending along the trailing edge into the first fillet, the first center cooling discharge opening centrally located between the pressure side wall and the suction side wall.

2. The assembly of claim 1, wherein the assembly is at least one of a stator vane or a rotor blade.

3. The assembly of claim 1, wherein the airfoil further includes at least one second center cooling discharge opening extending along the trailing edge within the first fillet, the second center cooling discharge opening centrally located between the pressure side wall and the suction side wall.

4. The assembly of claim 3, wherein the airfoil further includes at least one second center cooling discharge opening extending along the trailing edge between the pressure side biased cooling discharge opening nearest the first fillet and the first center cooling discharge opening, the second center cooling discharge opening centrally located between the pressure side wall and the suction side wall.

5. The assembly of claim 1, wherein the first center cooling discharge opening has a width between the pressure side wall and the suction side wall of no less than 0.008 inches (0.20 mm).

6. The assembly of claim 5, wherein an end of the first center cooling discharge opening farthest from the first platform has a width between the pressure side wall and the suction side wall of about 0.008 inches (0.20 mm) and an end of the first center cooling discharge opening nearest the first platform has a width between the pressure side wall and the suction side wall of greater than 0.008 inches (0.20 mm).

7. The assembly of claim 1, wherein the first center cooling discharge opening is separated from the pressure side biased cooling discharge opening nearest the first fillet by a distance of between about 0.015 inches and 0.100 inches (0.38 mm and 2.54 mm).

8. The assembly of claim 1, further comprising:

a second platform connected to the airfoil opposite the first platform such that the pressure side wall and the second platform form an acute angle at the trailing edge; and the airfoil further includes:

a second fillet formed around a perimeter of the airfoil where the airfoil connects to the second platform; the plurality of pressure side biased cooling discharge openings along the trailing edge not extending into the second fillet; and a second center cooling discharge opening extending along the trailing edge into the second fillet, the second center cooling discharge opening centrally located between the pressure side wall and the suction side wall.

9. A gas turbine engine comprising:

a compressor section; and a turbine section connected to the compressor section such that the compressor section provides at least cooling air to the turbine section, the turbine section including:

a plurality of assemblies, at least one of the plurality of assemblies including:

a first platform;

an airfoil extending from the first platform, the airfoil including:

a suction side wall connecting a leading edge and a trailing edge;

a pressure side wall spaced apart from the suction side wall, the pressure side wall connecting the leading edge and the trailing edge, the pressure sidewall and the first platform forming an acute angle at the trailing edge;

a first fillet formed around a perimeter of the airfoil where the airfoil extends from the first platform;

a plurality of pressure side biased cooling discharge openings along the trailing edge outside of the first fillet, each pressure side biased cooling discharge opening extending from the trailing edge along the pressure side wall, and a first center cooling discharge opening extending along the trailing edge into the first fillet, the first center cooling discharge opening centrally located between the pressure side wall and the suction side wall.

10. The engine of claim 9, wherein the assembly is at least one of a stator vane or a rotor blade.

11. The engine of claim 9, wherein the airfoil further includes at least one second center cooling discharge opening extending along the trailing edge within the first fillet, the second center cooling discharge opening centrally located between the pressure side wall and the suction side wall.

12. The engine of claim 9, wherein the airfoil further includes at least one second center cooling discharge opening extending along the trailing edge between the pressure side biased cooling discharge opening nearest the first fillet and the first center cooling discharge opening, the second center cooling discharge opening centrally located between the pressure side wall and the suction side wall.

13. The engine of claim 9, wherein the first center cooling discharge opening has a width between the pressure side wall and the suction side wall of no less than 0.008 inches (0.20 mm).

14. The engine of claim 13, wherein an end of the first center cooling discharge opening farthest from the first platform has a width between the pressure side wall and the suction side wall of about 0.008 inches (0.20 mm) and an end of the first center cooling discharge opening nearest the first platform has a width between the pressure side wall and the suction side wall of greater than 0.008 inches (0.20 mm).

15. The engine of claim 9, wherein the first center cooling discharge opening is separated from the pressure side biased cooling discharge opening nearest the first fillet by a distance of between about 0.015 inches and 0.100 inches (0.38 mm and 2.54 mm).

16. The engine of claim 9, wherein the assembly further comprises:

a second platform connected to the airfoil opposite the first platform; and the airfoil further includes:

a second fillet formed around a perimeter of the airfoil where the airfoil connects to the second platform; the plurality of pressure side biased cooling discharge openings along the trailing edge not extending into the second fillet; and a second center cooling discharge opening extending along the trailing edge into the second fillet, the second center cooling discharge opening centrally located between the pressure side wall and the suction side wall.

17. A method for producing an assembly for a turbine engine, the assembly including a platform and an airfoil extending from the platform, the airfoil including a suction side wall connecting a leading edge and a trailing edge; a pressure side wall spaced apart from the suction side wall, the pressure side wall connecting the leading edge and the trailing edge, the pressure sidewall and the first platform forming an acute angle at the trailing edge; a fillet formed around a perimeter of the airfoil where the airfoil extends from the first platform; a plurality cooling discharge openings along the trailing edge including a plurality of pressure side biased cooling discharge openings and a center cooling discharge opening; the pressure side biased cooling discharge openings disposed outside of the fillet and the center cooling discharge opening extending along the trailing edge into the fillet; each pressure side biased cooling discharge opening extending from the trailing edge along the pressure side wall and the center cooling discharge opening centrally located between the pressure side wall and the suction side wall, the method comprising the steps of:

casting the assembly as a single piece; and removing metal flashing from only a portion of the plurality of cooling discharge openings, the portion consisting of the plurality of pressure side biased cooling discharge openings.

* * * * *